US011241610B2

(12) United States Patent
Martikainen

(10) Patent No.: US 11,241,610 B2
(45) Date of Patent: Feb. 8, 2022

(54) METHOD FOR HANDLING INSULATION MATERIALS USED FOR STORING SNOW

(71) Applicant: Snow Secure Oy, Rukatunturi (FI)

(72) Inventor: Mikko Martikainen, Rukatunturi (FI)

(73) Assignee: Snow Secure Oy, Rukatunturi (FI)

( * ) Notice: Subject to any disclaimer, the term of this patent is extended or adjusted under 35 U.S.C. 154(b) by 0 days.

(21) Appl. No.: 16/347,350

(22) PCT Filed: Oct. 5, 2017

(86) PCT No.: PCT/FI2017/050701
§ 371 (c)(1),
(2) Date: May 3, 2019

(87) PCT Pub. No.: WO2018/083373
PCT Pub. Date: May 11, 2018

(65) Prior Publication Data

US 2020/0276491 A1 Sep. 3, 2020

(30) Foreign Application Priority Data

Nov. 7, 2016 (FI) ..... 20160270

(51) Int. Cl.
*A63C 19/10* (2006.01)
*E01H 4/02* (2006.01)
(Continued)

(52) U.S. Cl.
CPC ..... *A63C 19/10* (2013.01); *E01H 4/02* (2013.01); *A63C 2201/04* (2013.01);
(Continued)

(58) Field of Classification Search
CPC ... E01F 7/02; A63G 19/10; E01H 4/02; A63C 2201/04; A63C 19/10; A63C 19/12;
(Continued)

(56) References Cited

U.S. PATENT DOCUMENTS 3,713,879 A * 1/1973 Wu ..... D06M 13/285 442/143
4,032,139 A * 6/1977 Gaudard ..... A63C 19/10 472/90
(Continued)

FOREIGN PATENT DOCUMENTS

EP 0201987 A1 11/1986
JP H06-273023 A 9/1994
(Continued)

OTHER PUBLICATIONS

International Search Report and Written Opinion received for International Patent Application No. PCT/FI2017/050701, dated Jan. 29, 2018, 14 pages.
(Continued)

*Primary Examiner* — Michael D Dennis
(74) *Attorney, Agent, or Firm* — Ziegler IP Law Group, LLC

(57) ABSTRACT

A method for handling insulating materials used for storing snow, wherein the insulating materials covering a heap of snow stored through the summer are taken off the heap of snow before the snow in the heap of snow is transferred to a selected use. In the method, the insulating materials used for covering the heap of snow stored through the summer are transferred to such another use, in which the insulating materials have at least one function other than mere storage of the insulating materials.

17 Claims, 2 Drawing Sheets

(51) Int. Cl.
*E01C 13/12* (2006.01)
*F25C 3/04* (2006.01)

(52) U.S. Cl.
CPC ..... *E01C 13/12* (2013.01); *F25C 3/04* (2013.01); *F25C 2303/042* (2013.01)

(58) Field of Classification Search
CPC ..... E01C 13/12; F25C 2303/042; F25C 3/04; F25C 5/18
USPC ..... 256/12.5
See application file for complete search history.

(56) References Cited

U.S. PATENT DOCUMENTS 4,174,236 A * 11/1979 Dougherty ..... G01R 31/59 156/51
4,637,189 A * 1/1987 Maria van Riet ..... E04B 1/762 52/309.8
4,774,777 A * 10/1988 Brochu ..... A63C 19/12 37/197
5,285,607 A * 2/1994 Somerville ..... E04B 1/762 52/235
2002/0157329 A1* 10/2002 Berdan, II ..... E04B 9/06 52/144
2003/0131935 A1* 7/2003 Dyne ..... B32B 37/1027 156/308.2
2003/0167719 A1* 9/2003 Aiderman ..... B32B 3/20 52/407.3
2004/0164285 A1 8/2004 Bernasconi
2008/0295434 A1* 12/2008 Bills ..... E04B 1/7654 52/506.01
2012/0168986 A1* 7/2012 Warnshuis ..... C04B 26/16 264/328.1

FOREIGN PATENT DOCUMENTS

JP H09-094318 A 4/1997
JP 2005-291605 A 10/2005
JP 2005291605 * 10/2005 ..... F25C 5/02
JP 2008-082592 A 4/2008

OTHER PUBLICATIONS

International Preliminary Report on Patentability received for International Patent Application No. PCT/FI2017/050701, dated Oct. 30, 2018, 36 pages.

* cited by examiner

METHOD FOR HANDLING INSULATION MATERIALS USED FOR STORING SNOW

FIELD

The aspects of the disclosed embodiments relate to a method for handling insulating materials used for storing snow.

BACKGROUND

Storing snow at ski resorts through the summer has been studied and developed in Finland, among other countries. At Ruka Ski Resort, the world's first test slope covered with snow stored through the summer was opened in the autumn of 2001. Sawdust was used as an insulating material applied on the snow. Subsequently, this method for storing snow has gained popularity particularly as a method for storing snow which is stored through the summer and used for making so-called first snow ski tracks. Sawdust is a good insulating material as such, but it involves the drawback of the large amount of sawdust needed in relation to the amount of snow to be stored, as well as the resulting difficulties relating to the transfer and storage of the insulating material. Therefore, particularly in the storage of snow for ski slopes, other insulating materials and insulating methods suitable for using them have become widely applied as well. One such method that has become common in addition to the application of sawdust for storing snow, is to use geotextile, normally having a colour as white as possible, spread on a heap of snow for insulation. Furthermore, insulating materials used in construction industry, such as insulating materials of polyurethane or polystyrene in the form of roll-up material or boards, have been considered and tested. Geotextile has poorer thermal insulation properties than insulating materials of polyurethane or polystyrene, but it has the advantage of breathability, allowing the geotextile and thereby the air underneath it to cool down as a result of a phase change of liquid when the moisture in the geotextile that has become wet evaporates. Thus, the effect of the geotextile to prevent snow from melting is also partly based on the natural cooling effect of wet geotextile when it dries in warm and dry ambient air.

Storing snow through the summer by present methods has been found successful and in many cases also economically viable, because it has made it possible to extend the lucrative downhill and/or cross-country skiing season at ski resorts. However, present methods generally involve the drawbacks of a large storage space required for the large amounts of insulating material, and the transport of the insulating materials after the snow storage season. Attempts have been made to solve this problem e.g. by developing different insulating materials and methods for installing them.

A known snow storages and methods for storing snow are described in the patent application publications JP 2005291605, JP 2008082592 and JP 09094318.

BRIEF SUMMARY

It is an aim of the aspects of the disclosed embodiments to provide a method for handling insulating materials used for storing a heap of snow through the summer, to further improve the storage of snow through the summer and thereby to extend the skiing season at ski resorts, resulting in higher profitability and economical viability. In particular, it is an aim of the invention to present a method for significantly reducing non-productive labour and extra space needed for storing insulating materials used for storing a heap of snow through the summer, and for reducing the total amount of different materials needed in different ski resort operations, and thereby for achieving significant cost savings.

The aim of the aspects of the disclosed embodiments are achieved by a method in which insulating materials used for storing a heap of snow through the summer are also used for the needs of the ski resort during the skiing season so that at least part of the thermal insulating materials used as materials for insulating a heap of snow through the summer are taken to another use than merely being stored during the skiing season. Consequently, the insulating materials are transferred from the top of a heap of snow stored through the summer, for example, to at least one of the following objects to be placed in the area of the ski resort: impact shields, jump cushions, space dividers, protective fences, various temporary buildings and constructions, as well as applications in which insulating materials used for storing snow through the summer are used for insulation or supplementary insulation of thermal storages.

The method according to the aspects of the disclosed embodiments has the advantage of avoiding, totally or in part, the separate storage of insulating materials used for the storage of snow, during the skiing season. Furthermore, the overall need of materials used at the ski resort is reduced, because the insulating materials used for storing snow may be used to replace materials which would otherwise be purchased separately and used for building structures and constructions, such as e.g. impact shields, jump cushions, space dividers, protective fences, or insulating materials for various thermal storages. This enables saving a significant part of various material costs otherwise caused at ski resorts, which naturally further improves the profitability of a modern ski resort as a business.

The method presented in the application for insulating a heap of snow stored through the summer would provide significant advantages to methods of prior art even in the case that the insulating materials were only used for the storage of snow through the summer.

DESCRIPTION OF THE DRAWINGS

In the following, the aspects of the disclosed embodiments will be described in more detail with reference to the appended drawings, in which.

DETAILED DESCRIPTION

Figure 1:
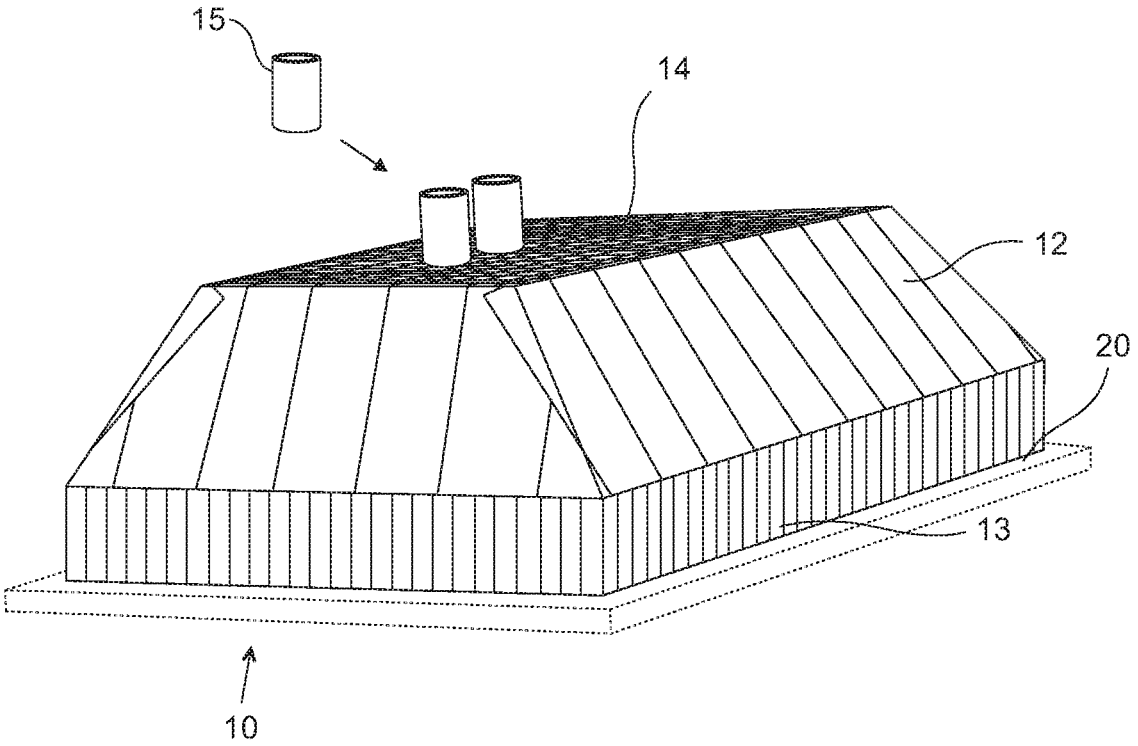
FIG. 1 shows a heap of snow to be stored through the summer by applying insulating materials used in a method according to the invention, in a slanted view from the side.
Figure 2:
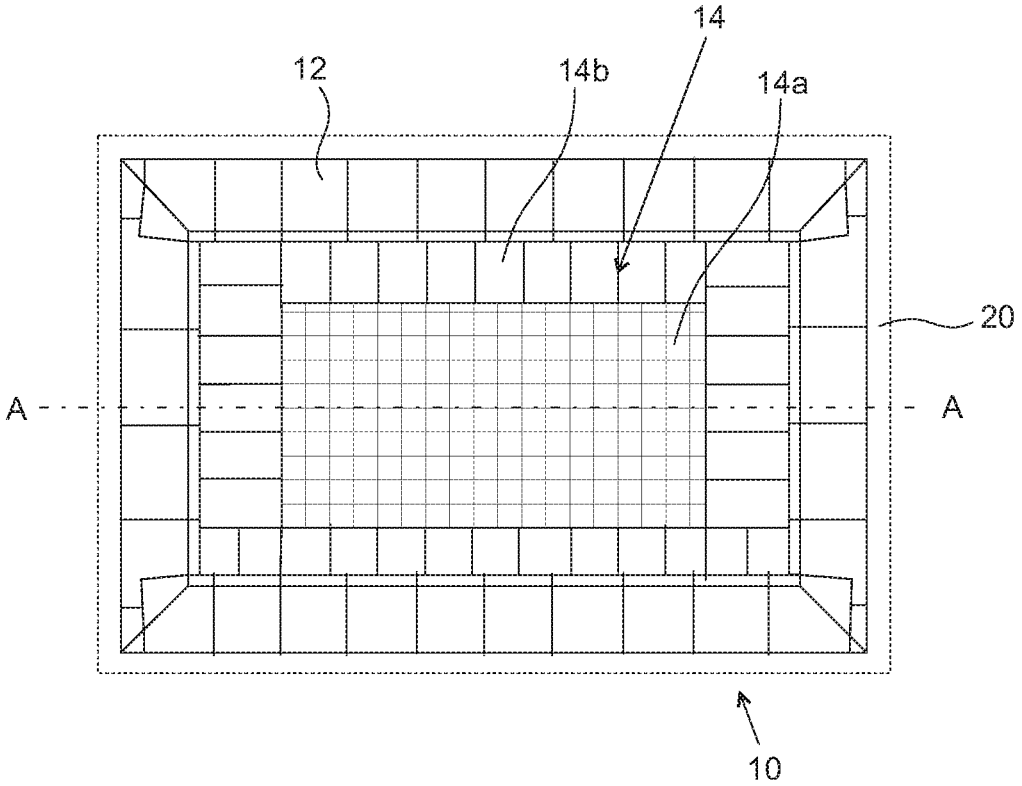
FIG. 2 shows a top view of the heap of snow to be stored through the summer, as shown in FIG. 1.
Figure 3:
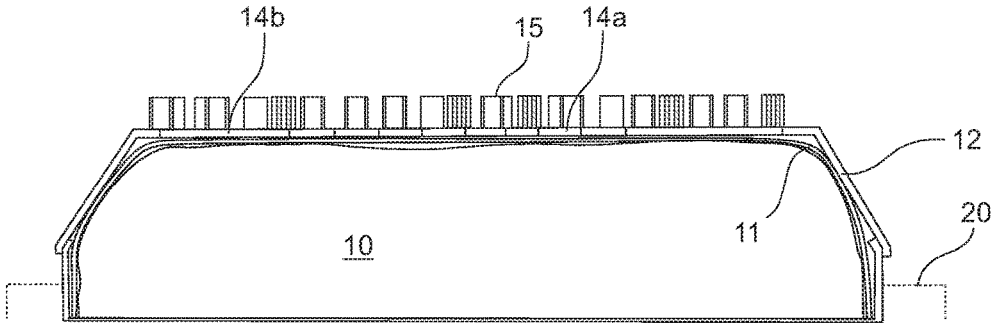
FIG. 3 shows the cross-section A-A of FIG. 2 representing the heap of snow to be stored through the summer, as shown in the preceding figures.

FIGS. 1 to 3 show how a method according to the invention is applied at a skiing resort for storing a heap of snow 10, built up of natural snow and/or snow made by snow guns in the spring, by means of insulation materials 11 to 15 through the summer. It is thus possible, at the beginning of the next skiing season (before the fall of natural snow or a possibility to make artificial snow by snow guns), to use snow stored through the summer for preparing e.g. a ski slope, a so-called first snow track or another object to be made by means of snow. The skiing season refers to a period of time when the outdoor temperature is sufficiently low to enable skiing on a terrain covered with snow made by snow guns, or with natural snow (in the Nordic countries, for example, the skiing season is typically a period from mid-October to the end of April).

In the example embodiment of the heap of snow 10 insulated through the summer, as shown in FIGS. 1 to 3, a number of various insulation materials 11 to 15 are used for insulating the heap of snow 10, which are called according to their way of placement as follows:

An insulating base material 11 is an insulating material used as the lowermost insulating layer on the snow to be stored. The insulating base material 11 is normally geotextile having a colour as light as possible and thereby reflecting light well (i.e. geotextile of white or silver colour). The geotextile used is normally available in rolls having a width of 2 to 6 meters. The rolls typically contain a length of e.g. 30 to 50 meters of geotextile. Using an insulating base material 11 covering the whole heap of snow 10 becomes increasingly important if aluminium or a corresponding reflecting foil is used in the insulating materials installed on top of it. The function of the insulating base material is thus to protect the aluminium or other reflecting foil from being rubbed against the snow and becoming damaged or worn in vain.

Wall insulating sheet 12 is used on the walls of the heap of snow 10 to be stored. The material used as the wall insulating sheet 12 may be, for example, white cellular plastic with a thickness of 20 mm, which is typically available in rolls of insulating cellular plastic having a width of 6 meters and a length of about 10 meters. The surface of the wall insulating sheet facing the snow may be coated with aluminium or a corresponding material reflecting thermal radiation.

Lower side insulating material 13 is insulating material for the lower part of the walls of the heap of snow 10, between the walls of the heap of snow 10 and the terrain surrounding the heap of snow 10, or a snow platform 20 made of snow on the sides of the heap of snow 10, to prevent warm air from entering underneath the insulating material layers from between the insulating base material 11 and the lower edge of the wall insulating sheet 13, and thereby melting the snow to be stored.

Top insulating material 14 consists of insulating material for covering the central parts of the heap of snow 10 (the area between the wall insulating sheets 12, or the "top"). The top insulating materials 14 may be e.g. insulation boards 14*a*, such as polyurethane insulation boards or polystyrene insulation boards. Velcro® tape or the like may be adhered crosswise and lengthwise on both sides or one side of the insulation board 14*a*. In the winter, the Velcro® or corresponding adhesive tape is used as a surface for fastening an advertisement 18 to be possibly adhered to the board in the winter; at the same time, the Velcro® tape or the like also prevents the board from being cut off and the parts from being detached from each other. The top insulating material 14 may also consist of roll-up top insulating sheet 14*b*. Thus, the roll normally has a width of 2 to 3 meters and a length of 3 to 10 meters. The roll-up top insulating sheets 14*b* and the insulation boards 14*a* may have a thickness in the same order, whereby they may be used in combination for insulating the same heap of snow 10 in such a way that part of the top insulating material 14 for the top of the heap of snow 10 is formed of insulation boards 14*a*, and part is formed of roll-up insulating sheet 14*b*, as shown in FIG. 3.

A top cushion 15 comprises several flexible cushion pieces 15*a* and consists of insulating material that can be installed on top of the top insulating material 14 or on top of an insulating fabric, geotextile or a mesh covering the top insulating material 14. The flexible cushion pieces 15*a* forming the top cushion 15 may be, for example, ready-made roll-like pieces made of Breathair® cushion material or the like.

The top cushion 15 may also be made of a band-like material which is rolled up on rolls having a height of 0.8 m, for example. The rolls are installed on a mounting base, for example on two drain pipes having a diameter of 50 mm. The rolls may be connected in series (that is, next to each other and/or one after another) so that the walls of the rolls abut each other. The number of rolls installed one after another on the mounting base may, for example, correspond to the width of the wall insulating sheet 12. For example, a wall insulating sheet 12 having a width of 6 m accommodates a 6 m row of top cushion rolls 15. If the wall insulating sheets are connected in series, for example in rolls of 2×6 m, the use of the top insulating sheet rolls is dimensioned to form a single roll of 12 m having a uniform appearance. The idea here is that the series of the top cushion rolls fits within the rolls formed of the roll-up wall insulating sheets when the wall insulating sheets are rolled up at the stage when the heap of snow is taken into use and the rolls are taken into winter use. One set of flexible cushions formed in this way and one roll of wall insulating sheet constitute one soft element. The soft elements may be used in various arrays, for example connected to each other merely by placing soft elements next to each other and/or one after another, or by attaching them to each other. In this way, they constitute the body of a jump cushion. The soft elements in the body are bundled together, for example by geotextile or PVC plastic.

FIGS. 1 to 3 show a heap of snow 10 formed of snow to be stored through the summer, after the installation of the insulating materials 11 to 15. The heap of snow 10 is formed of natural snow and/or snow produced by snow guns, collected in late winter. The heap of snow 10 made of snow to be stored through the summer, shown in FIGS. 1 to 3, is thus covered with the above described insulating materials 11 to 15, e.g. in the following way:

The insulation of the heap of snow 10 is started at its short end with an insulating base material 11 of a roll-up insulating material. At the installation stage, the insulating base material 11 is typically unrolled from the top of the heap of snow 10 downwards. At first, a geotextile having a width of 2 to 6 m (and e.g. a white colour) is installed at the end, folded in such a way that part of the geotextile comes on top of the snow platform 20 joining the wall of the heap of snow 10. The purpose of the snow platform 20 is to constitute a level working platform by the sides of the heap of snow 10. Part of the insulating base material 11 is installed on the wall of the heap of snow 10, on a height level of approximately 1.5 to 2 m. For the installation, e.g. spikes made of a material with low thermal conductivity, such as plastic, are punched through the geotextile into the snow. The purpose of the spikes is to prevent the geotextile from slipping off the heap of snow 10. Alternatively, the insulating base material 11 may also be installed by rolling from below upwards. For the fastening of the insulating base material 11, spikes are used at the installation stage. The spikes are punched or drilled into the snow through the insulating base material 11, to keep the insulating base material 11 in place on the snow.

The spikes may be removed at the stage of installing the actual insulating materials, that is, the wall insulating sheets 12, the lower wall insulating sheets 13, and the top insulating materials 14. Thus, the insulating base material 11 is integrated in (fastened to) the actual insulating material coming on top. The spikes may also be left in the snow and removed when the snow in the heap of snow 10 is taken into use.

After the installation of the insulating base material 11, wall insulating sheets 12 of e.g. cellular plastic with a thickness of 20 mm, typically delivered in rolls having a width of e.g. 2 to 6 m to the installation site, are installed on the walls of the heap of snow 10. Upon installing, the rolled-up wall insulating sheets 12 are unrolled and laid down from the top of the heap of snow 10 so that the lower ends of the wall insulating sheets 12 will cover about 0.05 to 0.5 m of the snow platform 20. A weight is or weights are installed onto the latter, as well as onto the other end of the wall insulating sheets 12 on top of the heap of snow 10 (not shown in the figures). Weights are also installed upwind on the wall insulating sheets 12 spread out so that wind cannot lift the wall insulating sheets 12 off the surface of the heap of snow 10 to be protected. The wall insulating sheets 12 may also be about 50% thinner on both sides than in the central areas. If the roll width is e.g. 6 m, both edges of the roll in the longitudinal (i.e. roll-up) direction may have a thickness of 10 mm instead of 20 mm over a width of 0.1 to 1 m. Thus, the thinner parts of the wall insulating sheets 12 are installed to overlap each other, whereby an insulating layer having a thickness of 20 mm, similar to the other areas, is also formed in the joint areas formed by two insulating base material layers having a thickness of 10 mm. One or more edges of the wall insulating sheets 12 may be sealed, to prevent water from entering into the insulation. One or more edges of the wall insulating sheets 12 may also be open in such a way that possible water may run from the inside to the outside of the insulating sheets.

For example, a chain-like roll having a width of about 200 mm may be used as a weight. The chain of weights on a roll is rolled down in a controlled manner so that the rolling down is started from the top of the heap of snow 10 and continued from above down to a point on the wall where the wall insulating sheets or the top insulating material ends and where the weights are used for preventing an air flow caused by wind from entering between the snow and the insulating material. Thus, the chain of weights may extend from the top of the heap of snow to the lower edge of the wall insulating sheet, or even across it. As the installation proceeds, after full wind protection has been achieved, the chain of weights is rolled up again and the roll can be re-used in the above described way.

After the installation of the wall insulating sheet 12, lower side insulating materials 13 are installed on the heap of snow. A lower side insulating material 13 to be installed in the lower part of the walls has, for example, a height of 2 m and a width of 1.5 m. The structure of the lower side insulating material 13 may be, for example, such that a non-water-absorbent cushion, such as Breathair® cushion material or the like, is provided between two layers of cellular plastic, whereby the total thickness is typically e.g. about 50 mm. The lower side insulating materials 13 may be linked together, side by side and/or on top of each other, by suitable fastening units. The upper parts of the lower side insulating materials 13 are connected to the wall insulating sheets 12 above them.

The installation of the lower side insulating materials 13 is followed by the installation of the top insulating materials 14. The top insulating materials 14 comprise insulation boards 14*a* or roll-up top insulation sheets 14*b*, or both of these. In the insulation solution shown in FIGS. 1 to 3, the insulation boards 14*a* are placed on top of the middle parts of the heap of snow, and the roll-up top insulation sheets are placed on the edge areas of the top, between the insulation boards 14*a* and the wall insulating sheets 12. These different top insulating materials 14 may also be arranged in a different array on the top of the heap of snow 10, or only insulation boards 14*a* or only roll-up top insulation sheets 14*b* may be provided on the top. A base geotextile (not shown in the figures) or a corresponding insulating material may be installed underneath the insulation boards 14*a*, being in many cases significantly larger than the area covered by the insulation boards 14*a*, whereby the parts of the base geotextile extending outside the insulated area may be folded onto the insulation boards. For securing that the combination formed by the insulation boards remains stationary, pegs may be installed in the outermost boards. The pegs may be hammered or screwed through installation holes provided in the outermost insulation boards. The same pegs may be used for fastening roll-up insulating materials (i.e. insulating base materials 11, wall insulating sheets 12, lower side insulating materials 13, or roll-up top insulating sheets 14*b*) by means of a fastening unit, such as a cord/rope loop integrated in the end of the roll-up insulating sheet. Roll-up top insulating sheets 14*b* are often installed around insulation boards covering the middle part of the heap of snow (as shown in FIG. 3). The roll-up top insulating sheets typically have a width of, for example, 2 to 3 m and a length of 3 to 10 m. The roll-up top insulating sheets 14*b* are made of a suitable soft insulating material (e.g. Breathair® cushion material coated on both sides). The thickness of the roll-up top insulating sheets 14*b* may vary, but it is advantageously equal to the thickness of the insulation boards 14*a* when it is used in combination with the insulation boards 14*a*. In this way, rainwater falling on top of the heap of snow 10 may be guided down from the top when the roll-up top insulating sheets 14*b* are arranged around the insulation boards 14*a* placed on top of the middle parts of the heap of snow 10. A top cushion 15, for example consisting of flexible cushion pieces 15*a*, may also be mounted on top of the roll-up top insulating sheets 14*b*.

The uppermost layer, or a topmost cover, on top of the heap of snow formed of snow stored through the summer may consist of e.g. a geotextile or tarpaulin (the topmost cover is not shown in FIGS. 1 to 4). The colour of the topmost cover is selected to maximize the reflection of sunlight falling on the insulating material layer covering the heap of snow 10. Preferable colours include white, silver and other suitable colours, such as a colour reflecting light in a mirror-like way. The topmost cover is fastened to the whole area of the heap of snow 10 in such a way that wind cannot move the lower insulation layers installed on top of the heap of snow 10. The topmost cover which is as impermeable and encompassing as possible, also serves the function of minimizing the entry of warm outside air underneath the insulation layers, in spite of wind, to prevent melting of the stored snow by the effect of heat transferred into it.

Normally, the topmost cover is composed of a number of separate pieces of geotextile, fabric or other suitable protective cover material (e.g. plastic film), but the topmost cover may also consist of a single uniform piece of geotextile, fabric or tarpaulin. When the topmost cover comprises several parts, the pieces of geotextile or tarpaulin forming the topmost cover are normally fastened to each other. In the case of fleecy geotextile, a suitable fastening means is Velcro® or corresponding adhesive tape, because Velcro® adhesive tape, or the like, has a so-called male surface, and the textured surface of the geotextile acts as a so-called female surface. If tarpaulins are used, they may also be attached to each other by e.g. adhesive tape (e.g. construction tape or the like) or in another suitable way. On top of the joints, a mesh may be installed, having a width of about 0.5 to 1 m and a length sufficient to extend across the heap of snow 10. Weights, such as sand bags, may be fastened to the mesh, for example by hooks. The purpose of the weights is to make sure that the tarpaulin and the insulating materials remain stationary in strong wind.

Ready-made flexible cushion pieces 15 may also be placed on the top insulating materials 14*a* and 14*b*, as shown in FIG. 3. These are, for example, hollow cylindrical pieces made of Breathair® material. These are ready on top of the heap of snow so that they can be inserted in the rolls made of the wall insulating sheets 12 or the roll-up top insulating sheets 14*b* at the stage when the wall insulating sheets 12 or the roll-up top insulating sheets 14*b* are rolled up again when taken off the heap of snow 10. Normally, the flexible cushion pieces 15 are inserted in the rolled-up wall insulating sheet 12 or the roll-up top insulating sheet 14*b* e.g. in such a way that the axis of symmetry of the cylindrical flexible cushion piece 15 is in a position perpendicular to the rolling axis of the rolled-up wall insulating sheet 12 or the roll-up top insulating sheet 14*b*. This provides the wall insulating sheet rolls 12*a* or the top insulating sheet rolls with more rigidity if they are used for building up e.g. a jump cushion 12*c* by placing insulating material rolls on their sides, next to and/or one after another. Another function of the flexible cushion pieces 15 during the summer is to provide the heap of snow with shade, whereby the heating effect of sunlight on the top insulating materials is reduced during periods of sunshine. The shape of the flexible cushion pieces 15 may also be different from cylindrical, such as rectangular, conical, or oval.

Figure 4:
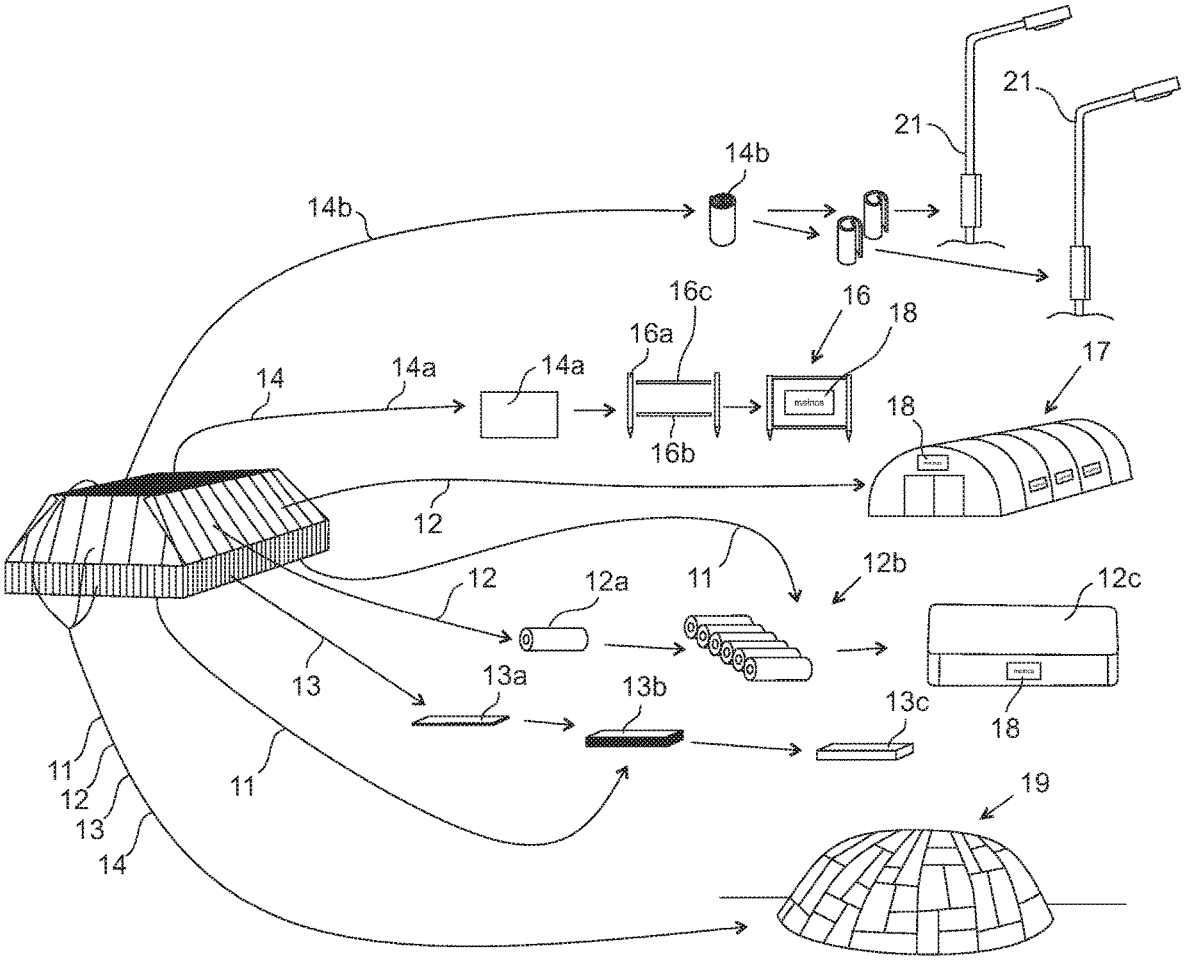
FIG. 4 shows a schematic chart on how the insulating materials applied on top of the heap of snow stored through the summer, as shown in FIGS. 1 to 3, are transferred for another use than merely being stored at the ski resort during the skiing season.

During the skiing season, the insulating materials 11 to 15 on top of the heap of snow 10 shown in FIGS. 1 to 3 are used in the way according to the invention for at least one purpose other than for their storage. According to the method of the invention, the insulating materials on the heap of snow 10 shown in FIGS. 1 to 3 are used during the skiing season e.g. in the following ways shown in FIG. 4:

The insulating base material 11 (e.g. geotextile of white colour) may be used for bundling wall insulating sheet rolls 12*a* made of wall insulating sheet material 12 in the way shown in FIG. 4. The wall insulating sheet rolls 12*a* may be bundled together as a uniform package by wrapping insulating base material 11 around them. For example, as shown in FIG. 4, 10 wall insulating sheet rolls 12*a*, made of wall insulating sheet material 12 and having a width of 6 m and a diameter of 1 m, are bundled up to form a set of rolls 12*b* having outer dimensions of about 10 m×6 m×1 m, which is wrapped to make a single package 12*c* by means of the remaining insulating base material 11. The insulating base material 11 used for packaging is cut to suitable size, wrapped around the set of rolls 12*b*, and the ends of the insulating base material are fastened to the packed rolls or the preceding layer of insulating base material, for example by using Velcro® adhesive tape.

The wall insulating sheets 12 are rolled up and brought to the winter uses. A set of flexible cushion pieces formed of the flexible cushion pieces 15 on the top is inserted into the wall insulating sheet rolls 12*a* of roll-up insulating material from the wall insulating sheets 12 in such a way that the set of flexible cushion pieces 15 inserted into the rolls made of the wall insulating sheets 12 or the roll-up top insulating sheet 14*b* comprises a number of flexible cushion pieces connected to each other whose total length corresponds to the width of the rolls 12*a*. Also, the wall insulating sheet rolls 12*a* formed of the wall insulating sheets 12 may be bundled up as presented above in connection with the description of the use of the insulating base material 11. Jump cushions of different sizes are then formed of the bundled-up wall insulating sheet rolls 12, which are, for example, of a type similar to the air-filled jump cushions commonly in use at ski resorts. The wall insulating sheet rolls 12*a* made of wall insulating sheets 12 and flexible cushion pieces 15 on top of the heap of snow 10 may also be used one by one or a number of them placed next to and/or one after another, in any suitable array. Single cushions may be installed, for example, in a row, whereby they constitute a soft shield which may be utilized in the form of various slope safety materials. Wall insulating sheets 12 may also be used as wall or top coatings for temporary storage and other constructions. Consequently, they may be used, as shown in FIG. 4, for erecting and insulating walls of temporary storage buildings 17 for e.g. snow grooming machines and various equipment used at the ski resort. The outer walls of the temporary storage building can be utilized as advertising space, on which e.g. companies supporting the operation of the ski resort may fasten advertisements 18 relating to their services or products.

Lower side insulating materials 13 may be used as such, for example as impact shields formed by one or more pieces placed on top of each other. In the way shown in FIG. 4, the lower side insulating materials 13 are piled up in bundles 13*a* and wrapped in e.g. insulating base material 11, whereby the packages 13*b* formed of the lower side insulating materials can be used alone as impact shields 13*c*. The number of layers of insulating material in the bundles 13*a* may vary according to the use. Normally, impact shields 13*c* made of the lower side insulating materials 13 also have visible surfaces on which advertisements can be fastened, whereby these surfaces may be utilized for selling advertising space for advertisers, which also contributes to making the storage of the lower side insulating materials more cost-effective during the skiing season. In addition to advertisements, the surfaces may be provided with safety signs and colours Insulation boards 14*a* used as top insulating material 14 on the heap of snow 10 may be utilized as space dividers and fence elements 16 for building up fences as shown in FIG. 4. As shown in FIG. 4, the ends of the insulation boards 14*a* are provided with two or more slope marking or slalom poles, posts or the like 16*a* installed next to each other on either side of the insulation board 14*a*. A support 16*b* is installed between the poles or posts on either side of the insulation board 14*a*, in the lower part of the insulation board 14*a*, and a holder 16*c* is installed on top of the board. A single fence element 16 is formed by the insulation board 14*a*, the poles/posts 16*a*, the supports 16*b*, and the holders 16*c*. The poles/posts 16*a* are pierced into the snow, the insulation board 14*a* is installed in the supports 16*b* and the holders 16*c*. The supports 16*b* and the holders 16*c* are mounted on the poles/posts 16*a* in such a way that their height level is adjustable. Instead of poles/posts 16*a* to be pierced into snow, it is possible to use any suitable stick or post, such as a fence post with a foot or another supporting mechanism by which it can be mounted on or supported to a base on which it is difficult or impossible to erect a pierced pole/post. Moreover, fences or space dividers formed of fence elements 16 are good targets for advertisers, whereby they may also be provided with the possibility of fastening advertisements 18, for example as shown in FIG. 4.

In the winter, base geotextile or corresponding material used for insulating snow stored through the summer is used, for example, in the same way as insulating base material 11.

Roll-up top insulating sheets 14*b* made of roll-up insulation material may be used, for example, for cushioning various poles and/or posts, such as ski lift poles and, for example, lighting poles 21 mounted on a ski slope, as shown in FIG. 4, for increasing safety on the slope. Upon installation of a roll-up top insulating sheet 14*b* used in this way, it is brought from the top of the heap of snow 10 stored through the summer to the vicinity of a pole or post, and is wrapped on a suitable height level around said pole or post, and fastened to the preceding layer of the insulating sheet. The mesh installed on top of the joints of the topmost cover and having a width of about 0.5 to 1 m may be cut to a suitable length and rolled up. The roll becomes a cushion which may be installed on the most likely impact areas of poles and/or posts before these areas are wrapped in the roll-up top insulating material 14.

Advertising space is also formed on the outer surface of poles and posts wrapped in the insulation materials. For example, the insulation material used for wrapping the lighting pole 21, as shown in FIG. 4, increases the diameter of the pole, whereby an advertisement 18 to be fastened on it can be made more visible by fastening it on the cushion than on the lighting pole 21 alone. The advertising space may also be integrated in a separate PVC or corresponding fabric which may be wrapped outermost over the insulation materials. Warning signs or safety/warning colours may also be added on the outer surfaces, in addition to the advertisements 18.

The geotextile, fabric or other tarpaulin used as the topmost cover on the heap of snow 10 is utilized, in the winter, as wall or roof coatings for temporary storage and other constructions, or for example as covers for packaging jump cushions formed of rolls of base or wall insulating sheets. Advertisements may be painted or printed on, or fastened to, these as well.

In the same way as the roll-up insulating base material 11 or the wall insulating sheets 12, the white flexible material of Breathair® type installed on top or the sides of the heap of snow 10 may be used for making rolls having a height of e.g. 0.5 to 1 m which may be used as flexible rolls in impact insulating materials and jump cushions. The flexible rolls formed in this way are inserted in the actual cushion rolls formed of e.g. base insulation material 11 or wall material 12, in the same way as the flexible cushion pieces 15 described above.

The insulation materials used on the heap of snow stored through the summer may also find many other uses at the ski resort during the skiing season. Preferably, these uses are naturally such where the insulation material may be used to replace a material which would otherwise have to be acquired separately.

In some cases, the insulation material might be used, for example, in building a covered first snow track or a so-called extension to a skiing tunnel (in the autumn) by a specific supplementary track which might thus be covered, for example, by means of a frame structure of metal pipes and an insulating coating layer fastened on top of it, utilizing the insulating materials used on the heap of snow stored through the summer.

Further uses might include various temporary accommodation, restaurant and storage facilities to be built in the area of the ski resort.

The insulating materials may also be utilized for the insulation or supplementary insulation of thermal storages used in the winter. For example, if buildings are heated by utilizing a source of heat whose thermal energy is based on a system collecting solar heat in a thermal storage (e.g. a fluid tank, or the like) in the daytime, this thermal storage may be insulated by using the above-mentioned insulating materials used for insulating snow stored through the summer. For example, the insulating base material 11, wall insulating sheets 12, lower side insulating materials 13, and top insulating materials 14 of the snow storage shown in FIGS. 1 to 3 may be used as insulating material for such a thermal storage 19 as shown in FIG. 4.

Furthermore, it should be noted that in the case of all such uses where the insulating materials constitute objects visible in the area of the ski resort, the insulating materials may be used as a support and/or a base for fastening various advertisements, commercial communications and notices. For fastening them, the surface of the insulating material may be provided with special fastening means or adhesive materials, such as Velcro® tape or adhesive surface. Advertisements or other information, such as route guidance and various safety and warning signs, may also be painted or printed on such an object.

Primarily, the use of insulating materials at ski resorts has been discussed above. However, the method and the snow storage forming an integral part of it may also find other uses in which snow fallen or produced by snow guns during the winter is to be stored for later use in the summer or autumn. In such cases, the insulated snow storage may be used, for example, in the following situations and/or uses:

1. The insulated snow storage may also be used as a water storage. The water is thus stored in its solid phase, that is, in the form of snow/ice. The use of a snow storage as a water storage gives great savings particularly at ski resorts where expensive basins of water have to be normally built for making snow. Thanks to the snow storage, the need of storing water in liquid phase is reduced, and no water has to be pumped to the sites for making snow.

2. An insulated snow storage may be used, for example, in a mining area where it is important to control the waters used. Thus, the snow storage may be built up e.g. for the purpose of securing the sufficient capacity of drainage basins by converting some of the water formed in the mining area to snow and a snow storage during the winter. After the winter, when natural snow melts, the capacity of retention basins will be more sufficient when they have been previously drained by converting water to a snow storage. The insulations of the snow storage may be used, for example, for insulating and preventing freezing of ore leaching heaps during the winter. Snow is also easier than water to be transported from the mining area to a suitable place where it does not, when melting, cause environmental problems but where it can be safely treated and purified before it is released into the environment.

3. An insulated snow storage may be built up in any place where it is possible to convert water into snow and to insulate the snow storage. For example, water may be converted into snow or a snow storage which is insulated. In the summer, the snow storage is used for cooling, providing savings in electricity and/or other energy consumed by cooling machines and equipment. At the same time, thermal energy may be collected in the summer in a suitable way (e.g. by heating water or another suitable thermally storing medium by solar collectors). It is possible to transfer the insulating materials used for insulating the snow storage through the summer, to cover the thermal storage for the winter, and thereby to utilize the thermal energy collected in the summer for heating buildings in the winter, for example. However, the temperature of the medium insulated in the thermal storage does not necessarily have to be very high; heat may be stored in a thermal storage having a large capacity and a relatively low temperature (e.g. only 20 to 40° C.) but containing a large amount of thermal energy, thanks to the large quantity of the medium. In this way, the thermal energy may be stored in the thermal storage as long as possible, in respect of the thickness of the insulating material layer used (because the temperature difference between the thermal storage and ambient air is small). The thermal energy of the medium at the low temperature may be transferred to heating use by raising the temperature of the medium by thermal pumps to temperatures (e.g. 60 to 120° C.) required by, for example, a heating system for buildings and/or a hot water heating system, for heating either a heating medium circulating in the heating system, or tap water. The medium in the thermal storage may also be heated during the cold seasons (for example, in a climate such as in Finland, typically in late autumn and early spring) on such days when e.g. a sufficient amount of solar heat is obtained for heating the primary medium. Furthermore, if, for any reason, a lot of heat is consumed (and a sufficient amount of solar energy has not been available), the medium in the thermal storage may be heated by using a suitable fuel, such as wood chips or other biofuels, or electrical heating devices.

Consequently, the method according to the invention is not limited to the example embodiments presented above, but it may further comprise many other embodiments which have not been described in more detail or mentioned above but which should be included in the scope of protection of the appended claims.

The invention claimed is:

1. A method for handling insulating materials used for insulating a heap of snow stored through a summer non-skiing season, wherein the insulating materials used for insulating the heap of snow stored through the summer non-skiing season are taken off the heap of snow stored through the summer non-skiing season before snow in the heap of snow stored through the summer non-skiing season is transferred and used for a selected use, and are used other than insulating the heap of snow stored through the summer non-skiing season, and wherein, the insulating materials used for insulating the heap of snow stored through the summer non-skiing season comprise at least one of the following insulating materials: geotextile, roll-up cellular plastic, roll-up cushion material made of an insulating material and coated on both sides thereof, insulation board made of polyurethane, or insulation board made of polystyrene, and the insulating materials used for insulating the heap of snow stored through the summer non-skiing season are used for at least one second use during a skiing season, wherein when the insulating materials comprise the geotextile, the roll-up cellular plastic, or the roll-up cushion material made of an insulating material and coated on both sides thereof, the at least one second use comprises impact cushions for poles and posts, or jump cushions, and wherein when the insulating materials comprise the insulation board made of polyurethane, or the insulation board made of polystyrene, the at least one second use comprises space dividers, protective fences, or insulating materials for temporary thermal stores.

2. The method according to claim 1, the method further comprising handling the insulating materials at a ski resort.

3. The method according to the claim 1, wherein the geotextile, the roll-up cellular plastic, and the roll-up cushion material made of an insulating material and coated on both sides thereof are rolled up before they are used in the at least one second use during the skiing season.

4. The method according to claim 3, wherein the rolled up insulating materials are bundled up and then packed to make the impact cushions for poles and posts or the jump cushions.

5. The method according to claim 1, wherein the insulation board made of polystyrene is used and installed between two or more poles or posts driven into a ground and/or snow, for forming one of the space dividers or one of the protective fences.

6. The method according to claim 1, wherein when used for insulating the heap of snow stored through the summer non-skiing season, the insulating materials are used as at least one of an insulating base material, a wall insulating sheet, a lower wall insulating sheet, or a top insulating material for the heap of snow stored through the summer non-skiing season.

7. The method according to claim 6, wherein the insulating base material consists of the geotextile, which is rolled up before it is used for the at least one second use.

8. The method according to claim 6, wherein in the at least one second use, the wall insulating sheet is rolled-up, and the insulating base material is used for wrapping the rolled-up wall insulating sheet.

9. The method according to claim 6, wherein in the at least one second use, the wall insulating sheet is rolled up before it is used as one of the impact cushions for poles and posts, or one of the jump cushions.

10. The method according to claim 9, wherein flexible cushion pieces are inserted in rolls formed of the wall insulating sheet.

11. The method according to claim 6, wherein a flexible cushion is formed of flexible cushion pieces, which are placed on the top insulating material.

12. The method according to claim 10, wherein the flexible cushion pieces are cylindrical rolls, which are inserted in rolls made of the insulating base material and/or the wall insulating sheet in the at least one second use.

13. The method according to claim 6, wherein in the at least one second use, rolls made of the wall insulating sheet and/or the top insulating material are installed next to and/or one after another to make up a soft protection.

14. The method according to claim 6, wherein in the at least one second use, the top insulating material includes roll-up top insulating sheets, which are wrapped around a support structure at a ski resort.

15. The method according to claim 14, wherein the roll-up top insulating sheets are rolled up before they are wrapped around the support structure at the ski resort.

16. The method according to claim 15, wherein the support structure comprises a ski lift support pole or a lighting pole.

17. The method according to claim 16, wherein the insulating materials used for insulating the heap of snow stored through the summer non-skiing season are used to make objects on which advertisements are fastened or which are provided with warning signs or safety/warning colours.

* * * * *